US006276280B1

(12) United States Patent
Nitti

(10) Patent No.: US 6,276,280 B1
(45) Date of Patent: Aug. 21, 2001

(54) ELEVATED TRAIN TRACK SUPPORT DEVICE

(76) Inventor: Ronald M. Nitti, 15082 W. Indianola, Goodyear, AZ (US) 85338

( * ) Notice: Subject to any disclaimer, the term of this patent is extended or adjusted under 35 U.S.C. 154(b) by 0 days.

(21) Appl. No.: 09/416,496

(22) Filed: Oct. 12, 1999

Related U.S. Application Data

(60) Provisional application No. 60/105,559, filed on Oct. 26, 1998.

(51) Int. Cl.[7] ..... B61B 3/02

(52) U.S. Cl. ..... 104/124; 105/53; 105/56; 105/125; 105/126; 248/523; 238/10 R

(58) Field of Search ..... 104/53, 56, 124, 104/125, 126; 238/10 R, 10 E, 10 F; 248/337, 523, 519; 403/180, 182, 183, 170, 335, 336, 337

(56) References Cited

U.S. PATENT DOCUMENTS

| | | | | |
|---|---|---|---|---|
| Re. 14,742 | | 10/1919 | Behr, Jr. . | |
| 1,943,659 | * | 1/1934 | Eason | 248/38 |
| 2,374,574 | * | 4/1945 | Adams | 403/180 |
| 3,299,565 | | 1/1967 | Yarashes | 46/235 |
| 3,581,987 | | 6/1971 | Tomaro | 238/10 E |
| 3,674,612 | | 7/1972 | Gehl, Jr. | 161/23 |
| 3,820,265 | | 6/1974 | Leonard | 40/106.3 |
| 3,858,339 | | 1/1975 | Short | 40/32 |
| 3,976,273 | * | 8/1976 | Kussow | 248/221 R |
| 4,383,487 | * | 5/1983 | Fitzner et al. | 108/27 |
| 4,632,038 | | 12/1986 | Lawrence | 104/120 |
| 4,718,630 | | 1/1988 | Richard | 248/444 |
| 4,826,076 | | 5/1989 | Hesse | 238/10 R |
| 4,898,326 | * | 2/1990 | Edwards et al. | 238/10 E |
| 4,901,971 | | 2/1990 | Connelly | 248/523 |
| 4,946,117 | * | 8/1990 | Liesegang | 248/65 |
| 4,978,098 | | 12/1990 | Peckinpaugh | 248/523 |
| 5,077,922 | | 1/1992 | Miller | 40/472 |
| 5,085,901 | | 2/1992 | Johnson et al. | 428/19 |
| 5,118,320 | | 6/1992 | Miller | 446/288 |
| 5,131,618 | * | 7/1992 | Chapin | 248/523 |
| 5,211,366 | * | 5/1993 | Cummings | 248/237 |
| 5,279,871 | | 1/1994 | Segan et al. | 428/18 |
| 5,450,682 | | 9/1995 | Franco et al. | 40/415 |
| 5,503,330 | * | 4/1996 | Riley | 238/10 E |
| 5,577,448 | * | 11/1996 | Leung | 104/53 |
| 5,632,107 | | 5/1997 | Meng-Suen et al. | 40/430 |

FOREIGN PATENT DOCUMENTS

| | | | |
|---|---|---|---|
| 789401 | 7/1968 | (CA) | 248/37 |

* cited by examiner

*Primary Examiner*—S. Joseph Morano
*Assistant Examiner*—Frantz F. Jules
(74) *Attorney, Agent, or Firm*—Quarles & Brady Streich Lang, LLP; Paul D. Amrozowicz

(57) ABSTRACT

An elevated toy train track is formed from multiple platform sections (12, 14, 16, 18) and a stabilizing ring (48) that are attachable together to form a ring-like structure (10). Each platform section has at least two lateral sides (34, 36), where one lateral side (34) has ridges (42) and the other lateral side (36) has slots (46). During assembly, the ridges (42) on one platform section are placed in snug engagement with complementary slots (46) of an adjacent platform section, until all platform sections are joined together. The stabilizing ring (48) is attached, using threaded fasteners (60), to the joined platform sections (12, 14, 16, 18) to form the ring-like structure (10). A train track (20) is attached to the ring-like structure, or can be integrally molded to the platform sections. The structure is attachable to the central pole (64, 66) of a Christmas tree, thus providing an elevated toy train track.

24 Claims, 5 Drawing Sheets

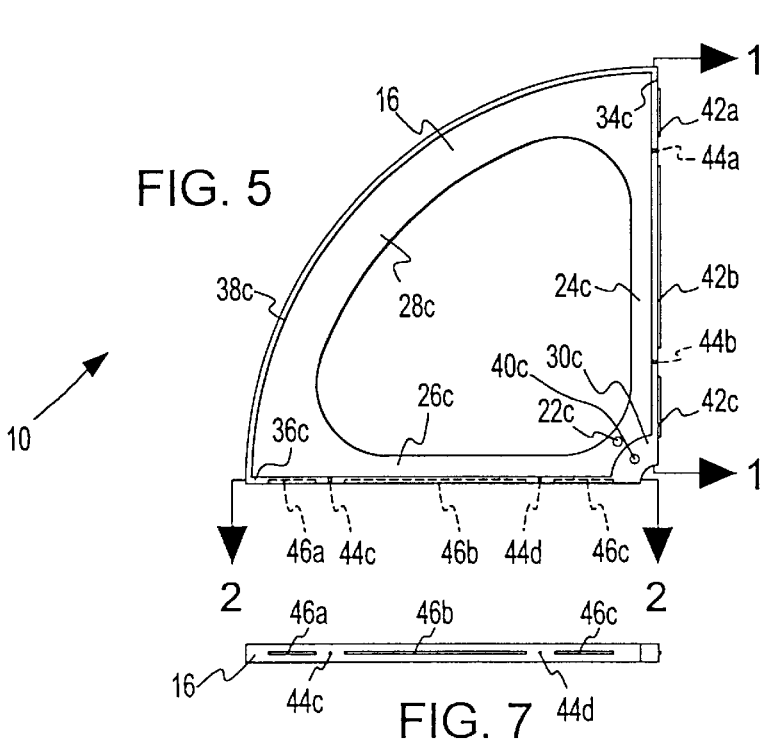
FIG. 5
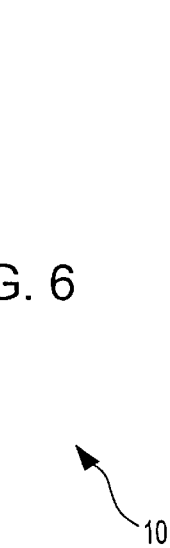
FIG. 6
FIG. 7
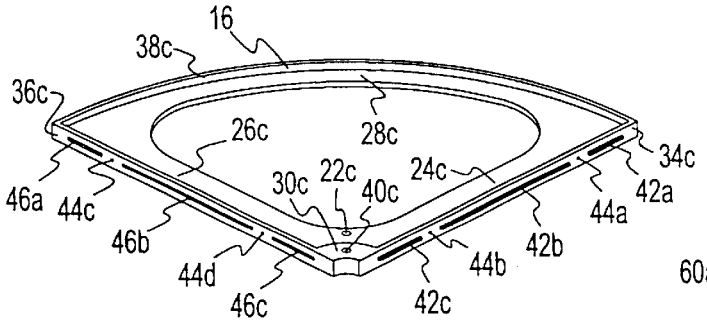
FIG. 8
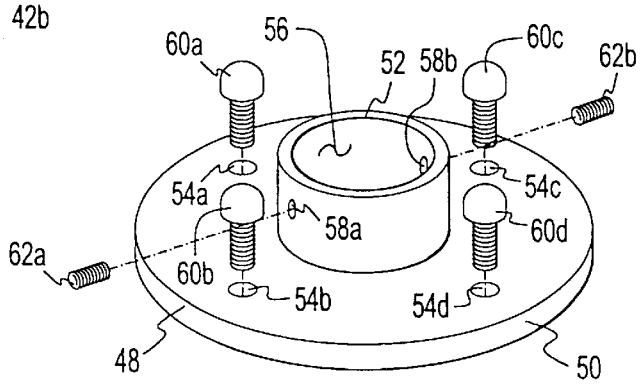
FIG. 9

ELEVATED TRAIN TRACK SUPPORT DEVICE

CROSS-REFERENCE TO RELATED APPLICATIONS

This application claims the benefit of U.S. provisional application Ser. No. 60/105,559, filed on Oct. 26, 1998, entitled "Elevated Christmas Tree Toy Train Track."

BACKGROUND OF THE INVENTION

1. Field of the Invention

The present invention is concerned with the field of toy train tracks and track support devices. More specifically, the present invention is concerned with devices or constructions that attach toy train tracks, which are either affixed thereto or manufactured integrally, to the central supporting pole of an artificial Christmas tree in order to raise the toy train track above the ground surface or base area of the Christmas tree.

2. Description of Related Art

One of the more enduring and endearing recent traditions of Christmas is the placement of a toy train track or toy train garden around the base of a Christmas tree for operation and enjoyment of model toy trains. In most cases, the toy train track serves as the outer boundary of the immediate area under the Christmas tree within which Christmas presents and other artifacts of Christmas are placed up to and after the Christmas holidays. Depending upon the size and nature of the family, the amount, size, and volume of the gifts and artifacts can vary dramatically, sometimes occupying nearly all the space under the Christmas tree, and, in some cases, spilling out onto adjacent areas. In any event, it has been found that the presence of a toy train track or train garden interferes with the placement and retrieval of Christmas presents, frequently resulting in crowding, jolting and sometimes damaging the toy train track, individual train cars, and ancillary electric equipment. Furthermore, the inherent crowding and limited space under a Christmas tree in such circumstances makes is difficult to operate and maintain the toy train in a normal and desirable manner, as access and operating space is limited or compromised. This situation is exacerbated when there are a large number of small, agitated children in the family, when there are an unusual amount of Christmas presents or artifacts placed under the tree and within or near the toy train track, and when the toy train track and train cars are in delicate or fragile condition, such as in miniature scale or antique models.

Designs for Christmas tree train tracks have been provided in the prior art. For instance, U.S. Pat. No. 5,131,618, issued to Chapin on Jul. 21, 1992, discloses an elevated Christmas tree track in which a toy train track is attached to supports consisting of arcuate sections and straight, elongate support sections that join to form a circular track support. The circular track support is raised above the base or floor surface and maintained at the desired height and position in a stationary mode by a plurality of support legs that extend down from the under side of the track support for some distance until they come into contact with the base or floor surface. The central shaft or pole of a Christmas tree is inserted within the central collar of the track support and passes therethrough until said shaft or pole reaches the base or floor surface at the same level as the support legs. As disclosed then, the central shaft or pole of the Christmas tree below the track support and immediately above said support is not fitted with tree branches thus presenting the appearance of a partially denuded Christmas tree or a tree with an excessively long central shaft or pole. In any case, the appearance of the Christmas tree that is compatible with this invention presents a less than natural and satisfying appearance.

It may be appreciated that there is a continuing need for a new and improved elevated Christmas tree toy train track. What is needed to overcome the aforementioned disadvantages of conventional toy train tracks and train gardens is the provision of a device or construction that exists in conjunction with a Christmas tree at some distance above the base or floor surface in order that a toy train can be operated and maintained at optimum conditions, and Christmas presents and other artifacts can be placed and retrieved without the apprehension of crowding, jolting, or damaging of a toy train.

BRIEF SUMMARY OF THE INVENTION

The apparatus of the present invention concerns an elevated track support device that includes multiple platform sections joined together to form a ring-like structure punctuated with a center aperture. Each of the multiple platform sections includes means of attachment to others of the multiple platform sections. The track support device also includes a stabilizing ring, attachable to the multiple platform sections, that has a circular base portion and a circular neck portion that encloses a stabilizing ring aperture. A pole can be extended through the stabilizing ring aperture and the center aperture of the ring-like structure so that the ring-like structure is supportable in a substantially parallel orientation to the ground.

BRIEF DESCRIPTION OF THE DRAWING

The foregoing and other objects, features and advantages of the apparatus of a preferred embodiment will become more fully understood from the following description of the preferred embodiment of the apparatus of a preferred embodiment as illustrated in the accompanying drawings in which like reference characters refer to the same parts throughout different views. The drawings are not necessarily to scale, emphasis instead being placed upon illustrating the principles of the apparatus of a preferred embodiment.

FIG. 5 is a plan view of the under side of a platform section of an elevated Christmas tree toy train track illustrating in detail stabilizing ridges and slots.

FIG. 6 is side view of a platform section taken along line 1—1 of FIG. 5.

FIG. 7 is side view of a platform section taken along line 2—2 of FIG. 5.

FIG. 8 is a perspective view of a platform section.

FIG. 9 is a perspective view of a stabilizing ring of an elevated Christmas tree toy train track illustrating the placement of threaded fasteners into various apertures therein.

DETAILED DESCRIPTION OF THE INVENTION

Figure 1:
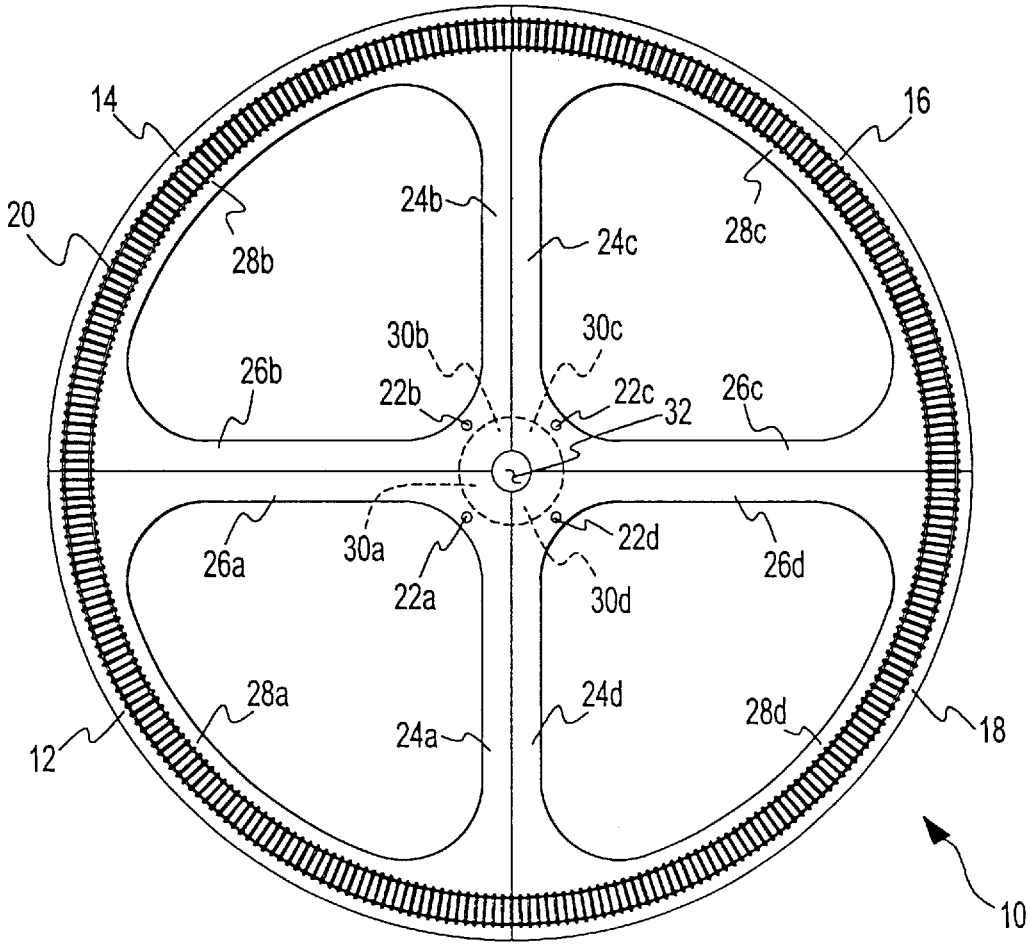
FIG. 1 is a plan view of the top side of an elevated Christmas tree toy train track shown assembled before mounting onto an artificial Christmas tree in accordance with a preferred embodiment of the present invention.

The apparatus of a preferred embodiment overcomes all of the shortcomings of the prior art listed previously, in addition to having novel aspects that will be described in detail hereinafter. The apparatus of the preferred embodiment substantially departs from the conventional concepts and designs of the prior art, and in so doing provides an apparatus that substantially fulfills the need for an elevated toy train track in that the apparatus of a preferred embodiment can be attached to conventional artificial Christmas trees in a manner that permits the complete and intended appearance of a Christmas tree to be preserved. The prior patent and commercial techniques do not suggest the present inventive combination of component elements arranged and configured as disclosed herein. The present invention achieves its intended purposes, objects, and advantages through a new, useful and nonobvious combination of component elements, with the use of a minimum number of functioning parts, at a reasonable cost to manufacture, and by employing only readily available materials.

Described briefly, according to a typical embodiment, the apparatus of a preferred embodiment presents an elevated Christmas tree toy train track, otherwise known as a track support device, which is assembled and releasably secured to the central pole or shaft of an artificial Christmas tree in order that a toy train can be operated thereon without interference from Christmas presents and other artifacts that are typically placed upon the floor surface beneath said Christmas tree. The track support device is an assembly of several components that are joined together in order to provide flexibility of placement and use upon the Christmas tree. In general, the track support device consists of multiple platform sections, a stabilizing ring, and a plurality of various threaded fasteners that are received by complementary apertures. In a preferred embodiment, four platform sections are employed to form a ring-like structure, although more or fewer platform sections could be used to form the structure. A section of toy train track can be releasably attached to the top surface of the platform sections or molded integrally thereto.

In a preferred embodiment, the platform sections are constructed of two straight, elongate support arms that are joined in perpendicular relation so that the support arms form a right angle or an L-shaped construction. An arcuate or semi-circular track support section covering 90 degrees of arc traverses the distance between the unattached ends of each support arm. The support arms and the track support section enclose a space or hollow area through which tree branches or Christmas tree decorations can be passed in order to facilitate installation and a natural appearance thereafter. On each platform section, one support arm is formed with multiple elongate ridges, and the other support arm is formed with multiple complementary slots.

In this manner, any one support arm of a platform can be joined to the support arm of an adjacent platform section when the ridges of said support arm are received by the complementary slots of said support arm of an adjacent platform section. When the platform sections are joined together in a construction that resembles a spoked wheel, they are secured by a series of threaded fasteners that are inserted into apertures formed within each support arm. Furthermore, the platform sections, when joined as described, form a center aperture that receives the central pole or shaft of a Christmas tree. A stabilizing ring is attached to the underside of the joined platform sections. The stabilizing ring is formed with a collar or neck section that contains a central aperture, said aperture designed for alignment under the aperture of the joined platform sections and apertures formed within the side wall of the collar or neck section.

To attach the track support device to a conventional artificial Christmas tree, the stabilizing ring is attached to the tip of the lower pole or shaft section of the tree and secured thereto by threaded fasteners that are inserted into the side wall apertures of the neck or collar section. The joined platform sections are placed onto the base of the stabilizing ring and releasably secured thereto by threaded fasteners. The upper pole or shaft section of the tree is placed within the remaining space of the collar of the stabilizing ring. As desired, tree branches and decorations can be passed through the space enclosed by each platform section to present a lifelike and uncluttered appearance and to facilitate operation of the toy train upon the track. An aperture formed within each platform section over the area where the stabilizing ring is attached permits a power cord to be passed therethrough for connection to the controlling power supply or transformer.

The platform sections and stabilizing ring can be manufactured of material that is light weight, durable, rigid yet sufficiently resilient with molded hard plastic, various resins, or the like constituting the preferred material. The preferred color is dark or evergreen green.

My invention, therefore, resides not in any one of these features per se, but rather in the particular combination of all of them herein disclosed. It is distinguished from the prior art in this particular combination of all of its structures for the functions specified. In as much as the foregoing has outlined rather broadly the more pertinent and important features of the present invention in order that the detailed description of the apparatus of a preferred embodiment that follows may be better understood so that the present contribution to the art can be more fully appreciated. Additional features of the apparatus of a preferred embodiment will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the apparatus of a preferred embodiment in detail, it is to be understood that the apparatus of a preferred embodiment is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention.

Figure 2:
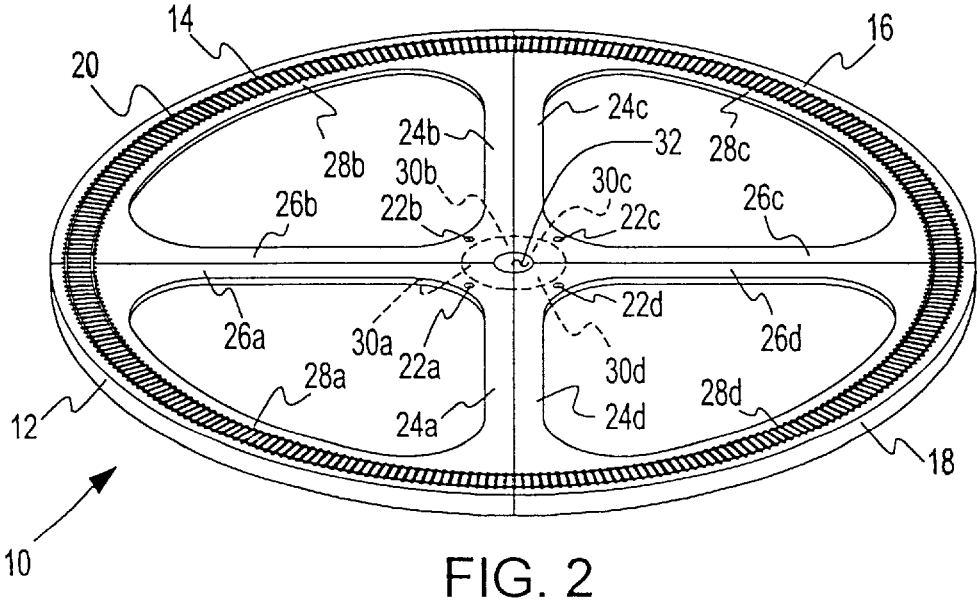
FIG. 2 is a perspective view of the top side of an elevated Christmas tree toy train track shown assembled before mounting onto an artificial Christmas tree.

Referring now to the drawings and, in particular, to FIG. 1 and FIG. 2 wherein there are illustrated a typical embodiment of an elevated Christmas tree toy train track 10. A preferred embodiment 10 permits the operation of toy trains, such as H.O. scale or other battery or electrically-powered trains or similar devices, while attached to the central pole or shaft of a conventional artificial Christmas tree and thereby suspended directly above the base or floor surface area at the foot of said Christmas tree where toy trains are normally assembled and operated in order to allow placement and retrieval of Christmas gifts and other artifacts without the attendant jolting and crowding of the toy train or train garden and to permit optimum viewing and ease of operation and maintenance of said toy train or train garden. The elevated Christmas tree toy train track 10 is an assembly of various components that are joined to form a contiguous structure. In general, the toy train track 10 consists of multiple platform sections 12, 14, 16, 18 that are joined in a method that will be described later to form a circular, ring-like structure punctuated with a center aperture 32. In a preferred embodiment, four platform sections are joined to form the ring-like structure, although more or fewer platform sections could be joined to form the structure in various embodiments.

A toy train track 20 is positioned onto the top surface of the outer edge of the toy train track 10, said track 20 releasably attached thereto by means well known in the art or formed integrally with each platform section 12, 14, 16, 18. Each platform section 12, 14, 16, 18 is comprised of a flat, elongate support arm 24*a, b, c, d* that is joined to a second flat, elongate support arm 26*a, b, c, d* in perpendicular relation so that any two joined support arms form an L-shaped structure. The unattached ends of joined support arms are connected by a flat, arcuate rim section 28*a, b, c, d* that traverses 90 degrees of arc. Although the apparatus of a preferred embodiment is described as forming a circular, ring-like structure, the arcuate rim sections could be shaped in a manner that, when connected, the platform sections form a structure that has more of an irregular circumference. For example, the shape of the arcuate rim sections could result in a structure upon which a toy train meanders in and out of the tree branches, rather than following a circular path.

The train track 20 is attached to the top surface of the rim sections 28*a, b, c, d* referred to earlier in this description as the outer edge of the toy train track 10. Apertures 22*a, b, c, d,* which are formed within in each platform section 12, 14, 16, 18 adjacent to the junction of the support arms, allow a power cord to be passed through so that the track 20 can be connected to a controlling power source or transformer in order to operate the toy train in the intended manner. A central, circular core section is formed around the aperture 32 of the joined platform sections 12, 14, 16, 18, said core section formed of four quarter sections 30*a, b, c, d* (shown in phantom) that exist substantially on the under side of each platform section 12, 14, 16, 18.

The platform sections 12, 14, 16, 18 can be manufactured of material that is molded in a heat injection process and is durable, attractive, light weight, rigid yet possessing a degree of flexibility to withstand breaking or snapping with molded hard plastic, resin, or the like comprising the preferred material. Although the intended color of manufacture of the material is green or evergreen green, other colors can be employed. When the platform sections are joined together, the approximate diameter of the assembly is 35 inches, although assemblies of other diameters may be employed and remain within the spirit and scope of the apparatus of a preferred embodiment.

Figure 3:
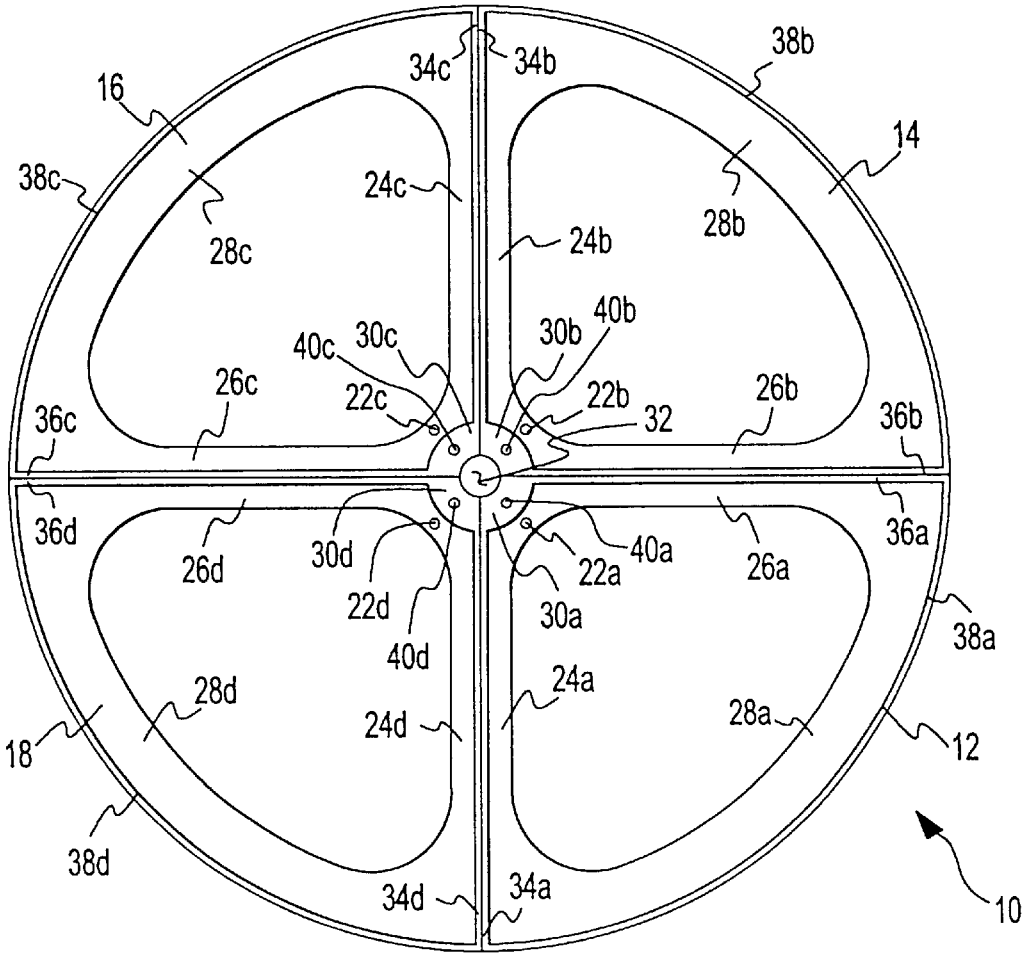
FIG. 3 is a plan view of the under side of an elevated Christmas tree toy train track shown assembled before mounting onto an artificial Christmas tree.
Figure 4:
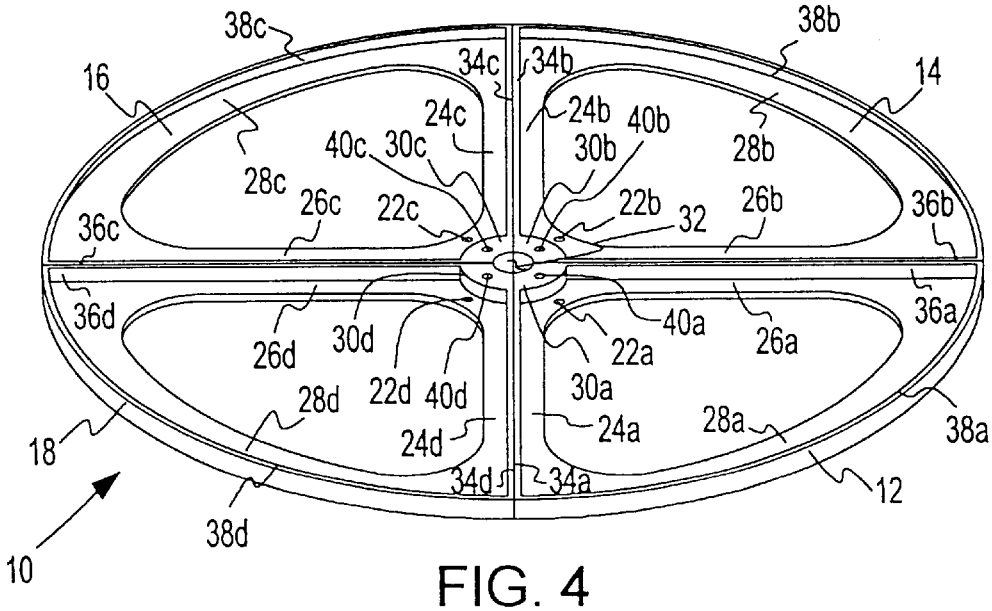
FIG. 4 is a perspective view of the under side of an elevated Christmas tree toy train track shown assembled before mounting onto an artificial Christmas tree.

Referring to FIG. 3 and FIG. 4, therein illustrated is the under side of the toy train track 10. Stability and resistance to bending and buckling of the platform sections 12, 14, 16, 18 is provided by a series of lateral sides that are joined to the support arms and rims in perpendicular relation. For instance, one set of support arms 24*a, b, c, d* are joined to a first set of lateral sides 34*a, b, c, d,* and another set of support arms 26*a, b, c, d* are joined to a second set of lateral sides 36*a, b, c, d*. Similarly, the rims 28*a, b, c, d* are joined in perpendicular relation to corresponding arcuate sides 38*a, b, c, d*. The junction of any two support arms within a platform section allows formation of an arcuate quarter section 30*a, b, c, d* of 90 degrees of arc that conjoin to form a collar that surrounds the central aperture 32. Each quarter section 30*a, b, c, d* is formed with a circular cavity 40*a, b, c, d* that extends partially through each quarter section. As best illustrated in FIG. 4, each quarter section 30*a, b, c, d* comprises in thickness the distance covered from the top side of a platform section 12, 14, 16, 18 to the distal edge of any one of the lateral sides in relation to the point of attachment to the support arms or rims.

In FIG. 5, FIG. 6, FIG. 7, and FIG. 8, therein are illustrated in detail an individual platform section 16 and the means of attachment to other platform sections. One lateral side 34*c* of a support arm 24*c* is formed with a series of narrow, elongate ridges 42*a, b, c,* and a second lateral side 36*c* of a second support arm 26*c* is formed with a series of slots 46*a, b, c*. In a preferred embodiment, three elongate ridges and three elongate slots are formed on the support arms, although more or fewer ridges and slots could also be formed in various alternate embodiments. In other alternate embodiments, different means of attachment could be used. For example, the lateral sides could have a tongue and groove configuration, and could slide or otherwise snap together.

In a preferred embodiment, the ridges of any one lateral side are designed to be received in snug engagement within the slots or a complementary lateral side of an adjacent platform section. In this manner, the ridges and slots function to align and stabilize the platform sections 12, 14, 16, 18 when they are joined together. The platform sections 12, 14, 16, 18 are secured in place by a series of threaded fasteners (not shown) that are received by apertures 44*a, b, c, d* formed within the lateral sides, for example sides 34*c*, 36*c*.

A stabilizing ring 48 is illustrated in FIG. 9 with associated threaded fasteners. The ring 48 is comprised of a flat, circular base 50 portion formed with a center aperture (not shown), a series of apertures 54*a, b, c, d* that receive threaded fasteners 60*a, b, c, d*, and a circular neck 52 portion that is centrally attached to or formed onto one side of the base 50 portion. The apertures 54*a, b, c, d* align with the circular cavities 40*a, b, c, d* on the under side or the joined platform sections so that threaded fasteners 60*a, b, c, d* can pass therethrough and engage the side walls of the circular cavities 40*a, b, c, d* in order to attach the stabilizing ring 48 to the joined platform sections 12, 14, 16, 18. In various alternate embodiments, different means of attaching the stabilizing ring to the joined platform sections could be employed. For example, the circular cavities 40*a, b, c, d* could pass all the way through the platform sections and could receive a pin or other fastener. Alternatively, the stabilizing ring could be joined to the joined platform sections using a hook-and-loop fastener, snaps or a slot/ridge configuration.

The neck 52 portion encloses an aperture 56 and is formed with two apertures 58*a, b* on its side wall for receipt of threaded fasteners 62*a, b,* which make contact with a Christmas tree pole and maintain the stabilizing ring 42 and platform sections in place. The outside diameter of the neck 52 portion is 1½ inches with an inside diameter consisting of either ¾ inch, 1 inch, or 1¼ inches, depending upon the application. In a preferred embodiment, the stabilizing ring 48 is manufactured of the same material and color as that of the platform sections 12, 14, 16, 18.

In an alternate embodiment, each platform section could have a portion of the stabilizing ring attached or integrally connected thereto. Thus, the stabilizing ring would be formed when all platform sections are joined.

Figure 10:
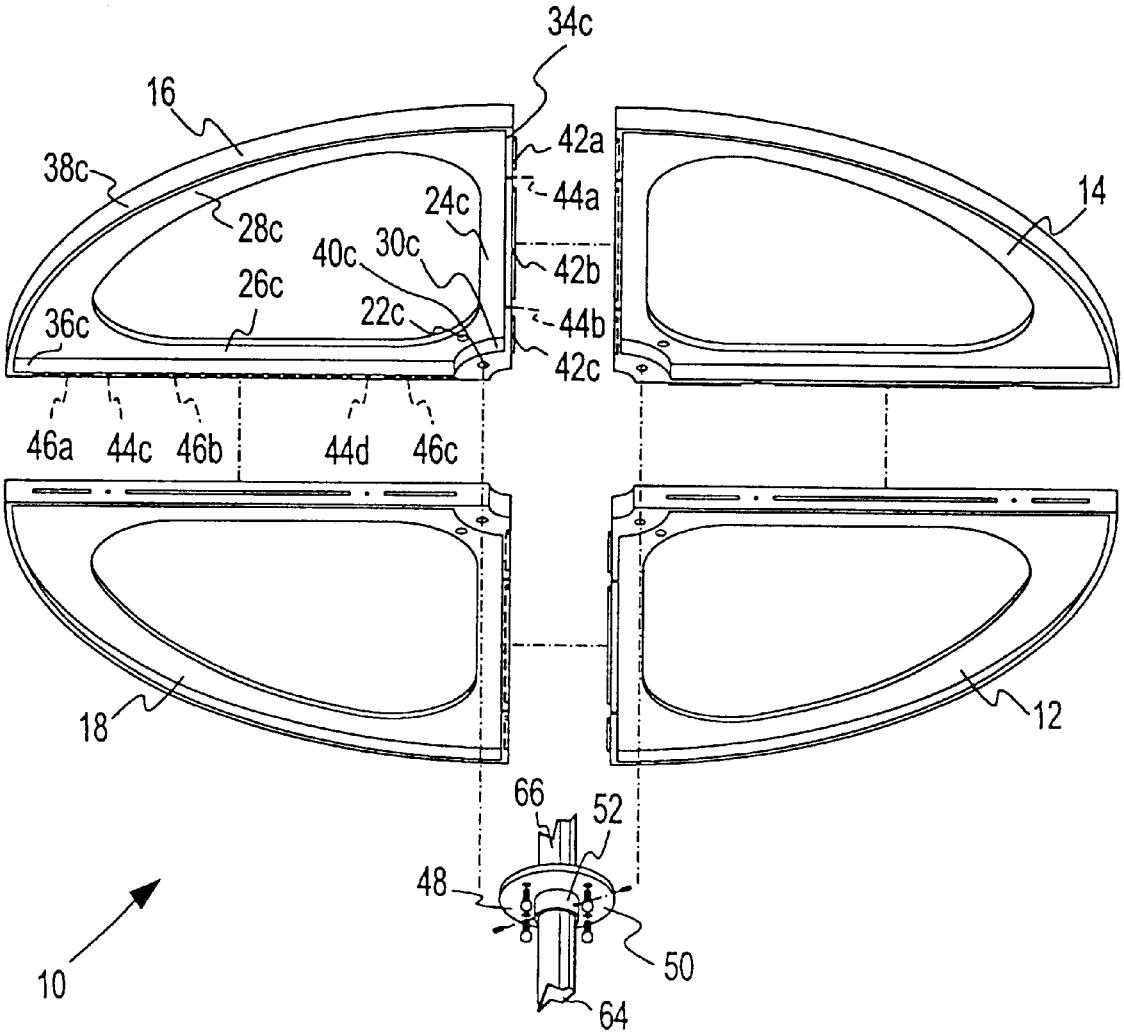
FIG. 10 is an exploded, perspective view of the under side of an elevated Christmas tree toy train track illustrating the alignment of the platform sections before and the stabilizing ring before attachment thereto.
Figure 11:
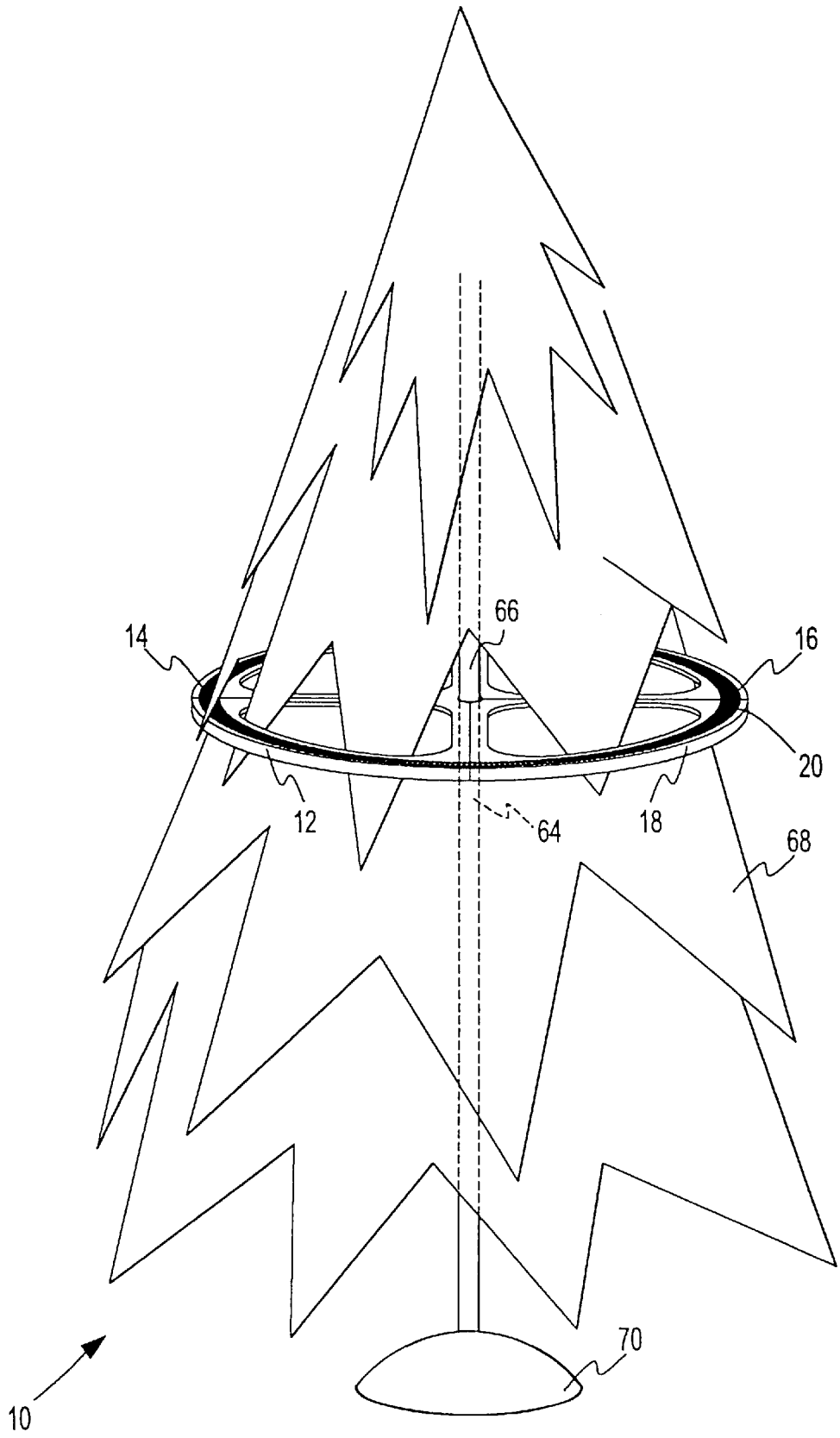
FIG. 11 is a perspective view of the elevated Christmas tree track attached to an artificial Christmas tree in the preferred manner.

The toy train track 10 is assembled and mounted to a Christmas tree as illustrated in FIG. 10. The platform sections 12, 14, 16, 18 are joined together by means of the stabilizing ridges and slots, apertures and threaded fasteners as described previously so that a continuous, uninterrupted track is formed. The stabilizing ring 48 is placed over a lower section 64 of the Christmas tree pole and secured thereto by threaded fasteners 62*a, b.* The apertures 54*a, b, c, d* of the base 50 align with the circular cavities 40*a, b, c, d* and receive threaded fasteners 60*a, b, c, d* as described earlier. An upper section 66 of the Christmas tree pole is fitted in snug engagement within a portion of the neck 52 not occupied by the lower section 64. The assembled and mounted toy train track 10 is illustrated in FIG. 11, wherein the platform sections 12, 14, 16, 18 and train track 20 are mostly visible. The toy train track 10 is mounted at the juncture of the lower 64 and upper 66 pole sections, a height that provides optimum viewing enjoyment and access. As such, the toy train track 10 is supported in an elevated, yet substantially parallel orientation to the ground. Furthermore, the appearance of the Christmas tree 68 is life-like and complete, extending from the base 70 to the tip.

While the apparatus of a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the apparatus of the present invention are desired to be protected. With respect to the above description then, it is to be realized that the optimum dimensional relationships for the parts of the apparatus of a preferred embodiment, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

From the foregoing, it will be understood by persons skilled in the art that an improved elevated toy train track has been provided. The apparatus of a preferred embodiment is relatively simple and easy to manufacture, yet affords a variety of uses. For example, although the apparatus of a preferred embodiment has been described with applicability to a Christmas tree, the invention could be used for any application in which an elevated track is desired. While my description contains many specifics, these should not be construed as limitations on the scope of the version of the invention, but rather as an exemplification of the preferred embodiment thereof. The foregoing is considered as illustrative only of the principles of the invention. Further, since numerous modification and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred embodiment with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. An elevated track support device comprising:

multiple platform sections joined together to form a ring-like structure punctuated with a center aperture, wherein each of the platform sections includes a first elongate support arm including at least one narrow, elongate ridge formed on a side of the first elongate support arm, a second elongate support arm joined to the first elongate support arm in perpendicular relation to form an L-shaped structure, forming a section of the center aperture, and including at least one slot formed on a side of the second elongate support arm, wherein the ridge is designed to be received in snug engagement with a slot on a complementary side of an adjacent platform section, an arcuate rim section joining unattached ends of the first and second elongate support arms and traversing 90 degrees of arc, at least one cavity for coupling the platform section to a stabilizing ring, and a series of lateral sides joined in perpendicular relation to the first and second elongate support arms and the arcuate rim section; the stabilizing ring, attachable to the ring-like structure, having a circular base portion including base apertures that align with the at least one cavity so that fasteners can pass through the base apertures and into the at least one cavity in order to secure the platform sections to the stabilizing ring, and a circular neck portion, centrally coupled to the circular base portion, that encloses a stabilizing ring aperture, the circular neck portion including neck apertures for receipt of threaded fasteners which maintain the stabilizing ring and the multiple platform sections in place, wherein a pole can be extended through the stabilizing ring aperture and the center paerture of the ring-like structure so that the ring-like structure is supported in a substantially parallel orientation to the ground; and a toy train track on a top surface of the ring-like structure.

2. An elevated track support device comprising:

multiple platform sections joined together to form a ring-like structure punctuated with a center aperture, wherein each of the multiple platform sections includes means of attachment to others of the multiple platform sections; and a stabilizing ring, attachable to the multiple platform sections, having a circular base portion and a circular neck portion that encloses a stabilizing ring aperture, wherein a pole can be extended through the stabilizing ring aperture and the center aperture of the ring-like structure so that the ring-like structure is supported in a substantially parallel orientation to the ground, wherein each of the multiple platform sections comprises:

a first elongate support arm;

a second elongate support arm joined to the first elongate support arm, forming a section of the center aperture; and an arcuate rim section joining unattached ends of the first and second elongate support arms, wherein the first and second elongate support arms include the means of attachment to the others of the multiple platform sections, and wherein each of the multiple platform sections further comprise a series of lateral sides joined in perpendicular relation to the first and second elongate support arms and the arcuate rim section.

3. The elevated track support device as claimed in claim 2, wherein the means of attachment comprises:

at least one narrow, elongate ridge formed on a first side of each of the multiple platform sections; and at least one slot formed on a second side of each of the multiple platform sections, wherein the ridge and is designed to be received in snug engagement with the slot on a complementary side of an adjacent platform section.

4. The elevated track support device as claimed in claim 2, further comprising securing apertures formed within lateral sides of the multiple platform sections for securing the multiple platform sections together using fasteners received by the apertures.

5. The elevated track support device as claimed in claim 2, wherein the circular neck portion of the stabilizing ring is centrally coupled to the circular base portion, and the circular base portion includes base apertures that align with cavities of the multiple platform sections so that fasteners can pass through the base apertures and at least a portion of the cavities in order to secure the multiple platform sections to the stabilizing ring.

6. The elevated track support device as claimed in claim 2, wherein the circular neck portion of the stabilizing ring includes neck apertures for receipt of threaded fasteners which, when assembled with the pole, make contact with the pole and maintain the stabilizing ring and the multiple platform sections in place.

7. The elevated track support device as claimed in claim 2, further comprising a toy train track positioned onto a top surface of the ring-like structure.

8. The elevated track support device as claimed in claim 7, wherein the toy train track is releasably attached to the top surface.

9. The elevated track support device as claimed in claim 7, wherein the toy train track is integrally molded with each of the multiple platform sections.

10. A platform section for an elevated track support device comprising:

a first elongate support arm;

a second elongate support arm joined to the first elongate support arm; and an arcuate rim section joining unattached ends of the first and second elongate support arms, wherein the first and second elongate support arms include means of attachment to other platform sections in order to form a ring-like structure punctuated with a center aperture, wherein the means of attachment comprises:

at least one narrow, elongate ridge formed on a first side of each of the multiple platform sections; and at least one slot formed on a second side of each of the multiple platform sections, wherein the ridge and is designed to be received in snug engagement with the slot on a complementary side of an adjacent platform section.

11. The platform section as claimed in claim 10, further comprising an arcuate stabilizing portion having a circular neck portion that encloses a portion of a stabilizing ring aperture, wherein when the platform section is attached to the other platform sections in order to form the ring-like structure, a pole can be extended through the stabilizing ring aperture so that the ring-like structure is supported in a substantially parallel orientation to the ground.

12. The platform section as claimed in claim 10, wherein the first and second elongate support arms are joined in perpendicular relation to form an L-shaped structure, and the arcuate rim section traverses 90 degrees of arc.

13. The platform section as claimed in claim 10, further comprising a series of lateral sides joined in perpendicular relation to the first and second elongate support arms and the arcuate rim section.

14. The platform section as claimed in claim 10, wherein the platform section is manufactured of a light weight, rigid material that is molded in a heat injection process.

15. An elevated track support device comprising:

multiple platform sections joined together to form a ring-like structure punctuated with a center aperture, wherein each of the multiple platform sections includes means of attachment to others of the multiple platform sections; and a stabilizing ring, attachable to the multiple platform sections, having a circular base portion and a circular neck portion that encloses a stabilizing ring aperture, wherein a pole can be extended through the stabilizing ring aperture and the center aperture of the ring-like structure so that the ring-like structure is supported in a substantially parallel orientation to the ground, wherein the means of attachment comprises:

at least one narrow, elongate ridge formed on a first side of each of the multiple platform sections; and at least one slot formed on a second side of each of the multiple platform sections, wherein the ridge and is designed to be received in snug engagement with the slot on a complementary side of an adjacent platform section.

16. The elevated track support device as claimed in claim 15, wherein each of the multiple platform sections comprises:

a first elongate support arm;

a second elongate support arm joined to the first elongate support arm, forming a section of the center aperture; and an arcuate rim section joining unattached ends of the first and second elongate support arms, wherein the first and second elongate support arms include the means of attachment to the others of the multiple platform sections.

17. The elevated track support device as claimed in claim 16, wherein the first and second elongate support arm are joined in perpendicular relation to form an L-shaped structure, and the arcuate rim section traverses 90 degrees of arc.

18. The elevated track support device as claimed in claim 16, wherein each of the multiple platform sections further comprise a series of lateral sides joined in perpendicular relation to the first and second elongate support arms and the arcuate rim section.

19. The elevated track support device as claimed in claim 15, further comprising securing apertures formed within lateral sides of the multiple platform sections for securing the multiple platform sections together using fasteners received by the apertures.

20. The elevated track support device as claimed in claim 15, wherein the circular neck portion of the stabilizing ring is centrally coupled to the circular base portion, and the circular base portion includes base apertures that align with cavities of the multiple platform sections so that fasteners can pass through the base apertures and at least a portion of the cavities in order to secure the multiple platform sections to the stabilizing ring.

21. The elevated track support device as claimed in claim 15, wherein the circular neck portion of the stabilizing ring includes neck apertures for receipt of threaded fasteners which, when assembled with the pole, make contact with the pole and maintain the stabilizing ring and the multiple platform sections in place.

22. The elevated track support device as claimed in claim 15, further comprising a toy train track positioned onto a top surface of the ring-like structure.

23. The elevated track support device as claimed in claim 22, wherein the toy train track is releasably attached to the top surface.

24. The elevated track support device as claimed in claim 22, wherein the toy train track is integrally molded with each of the multiple platform sections.

* * * * *